US008810463B2

(12) United States Patent
Kirkham

(10) Patent No.: US 8,810,463 B2
(45) Date of Patent: Aug. 19, 2014

(54) ANTENNA MOUNT

(76) Inventor: Jeffrey B. Kirkham, Salt Lake City, UT (US)

( * ) Notice: Subject to any disclaimer, the term of this patent is extended or adjusted under 35 U.S.C. 154(b) by 310 days.

(21) Appl. No.: 13/463,542

(22) Filed: May 3, 2012

(65) Prior Publication Data

US 2012/0280869 A1 Nov. 8, 2012

Related U.S. Application Data

(60) Provisional application No. 61/483,565, filed on May 6, 2011.

(51) Int. Cl.

| | |
|---|---|
| ***H01Q 1/12*** | (2006.01) |
| ***H01Q 1/32*** | (2006.01) |
| ***H01Q 21/26*** | (2006.01) |
| ***H01Q 1/27*** | (2006.01) |
| ***H01Q 1/08*** | (2006.01) |

(52) U.S. Cl.

CPC ..... *H01Q 1/273* (2013.01); *H01Q 21/26* (2013.01); *H01Q 1/084* (2013.01); *H01Q 1/1235* (2013.01)

USPC ..... 343/718; 343/715; 343/890

(58) Field of Classification Search

None

See application file for complete search history.

(56) References Cited

U.S. PATENT DOCUMENTS

| | | | | |
|---|---|---|---|---|
| 3,611,387 | A * | 10/1971 | Stover | 343/702 |
| 6,018,325 | A * | 1/2000 | Lundgren | 343/890 |
| 7,002,525 | B1 * | 2/2006 | Sergi | 343/715 |
| 2005/0062659 | A1 * | 3/2005 | Packer | 343/718 |
| 2007/0091004 | A1 * | 4/2007 | Puuri | 343/718 |
| 2009/0051609 | A1 * | 2/2009 | Packer et al. | 343/718 |
| 2011/0074644 | A1 * | 3/2011 | Wertman et al. | 343/718 |

* cited by examiner

*Primary Examiner* — Trinh Dinh

(74) *Attorney, Agent, or Firm* — Workman Nydegger

(57) ABSTRACT

Pedestrian transportable antenna systems can include an antenna mount and an antenna for satellite based or other communication mounted on a top face of the antenna mount. A bottom face of the antenna mount may be attached to a bendable rigid rod that is sufficiently rigid to provide support for the mounted antenna such that a user can walk around with the antenna deployed while the bendable rigid rod of the antenna system is mounted to the user's back (e.g., mounting into a back portion of a vest or flak jacket). The bendable rigid rod is sufficiently rigid to support the antenna without allowing the rod to "flop" over under the load of the antenna. At the same time, the rod is sufficiently bendable so as to permit the system to be drawn closer into a user's body when the antenna is not deployed (e.g., while stepping into a vehicle).

20 Claims, 8 Drawing Sheets

ANTENNA MOUNT

CROSS REFERENCE TO RELATED APPLICATIONS

This application claims the benefit of U.S. Provisional Patent Application No. 61/483,565, filed May 6, 2011 entitled ANTENNA MOUNT, the disclosure of which is incorporated herein in its entirety.

BACKGROUND

1. Field of the Invention

The present invention relates to antenna mounts. In particular, the invention relates to a portable antenna mount for use by an individual on foot.

2. Background and Relevant Art

While antenna systems are used generally in order to provide for improved transmittal and/or reception of radio or other communication signals, a need exists for a system that provides for portability, particularly in the context of a user that may be on foot (i.e., pedestrian). Such a user may be operating in a generally hostile environment (e.g., a combat zone). As such, there continues to be a general need for improved antenna mounts that can facilitate the overall convenience, speed and/or stealth at which the antenna mount can be deployed and/or broken down.

BRIEF SUMMARY

The present invention is directed to a pedestrian transportable antenna system. According to one embodiment, the antenna system includes an antenna mount and an antenna, such as, for example, for satellite based communication, which can be mounted on the antenna mount. While the antenna may be attached to a top face of the antenna mount (e.g. a mounting plate), the other face of the antenna mount may be attached to a bendable rigid rod that is sufficiently rigid to be self-supporting, so as to provide support for the mounted antenna such that a user can walk around with the antenna deployed. The antenna system may be mounted to a user's back (e.g., mounted into a back portion of a vest or flak jacket). The bendable rigid rod is generally sufficiently rigid to support the antenna mounted to a top portion thereof without allowing the rod to "flop" over or "noodle" under the load of the antenna. At the same time, the rod is advantageously sufficiently flexible and bendable so as to permit the system to be drawn closer into a user's body when the antenna is not deployed (e.g., while stepping into a vehicle).

In one embodiment, the rigid bendable rod has a ribbed, helically coiled interlocked configuration (e.g., similar to flexible metallic conduit or tubing) that allows the rod to bend as adjacent individual coil segments are adjusted relative to one another. A top antenna end of the bendable rigid rod may be connected to the mounting plate, and an antenna may be mounted on the opposite face of the mounting plate. A bottom free end of the bendable rigid rod may be mounted into a vest, flak jacket or other apparel worn by a user (e.g., using Modular Lightweight Load-carrying Equipment ("MOLLE") loops). When moved into a specified orientation (e.g., generally vertical), the rigid bendable rod has sufficient rigidity to maintain the specified position under the weight of the mounted antenna. However, with a moderate force applied by a user, the specified orientation of the rigid bendable rod can be adjusted, either temporarily (only when the force is applied) or persistently (even after the force is no longer applied).

In some embodiments, one end of the bendable rigid rod is attached to the antenna mount while the opposite end is mounted to the back of a user (e.g., using MOLLE loops on a flak jacket). So attached, the bendable rigid rod can be adjusted into an essentially vertical position for antenna deployment (e.g., extension of antenna members). When the antenna is undeployed (e.g., antenna members retracted), the bendable rigid rod can be bent over the user's shoulder and the antenna end attached to a retention mechanism (e.g., another MOLLE loop, pouch, hook and loop connector (e.g., VELCRO), etc.) located on the front chest surface of the user's vest or flak jacket.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

I. Introduction

Figure 1A:
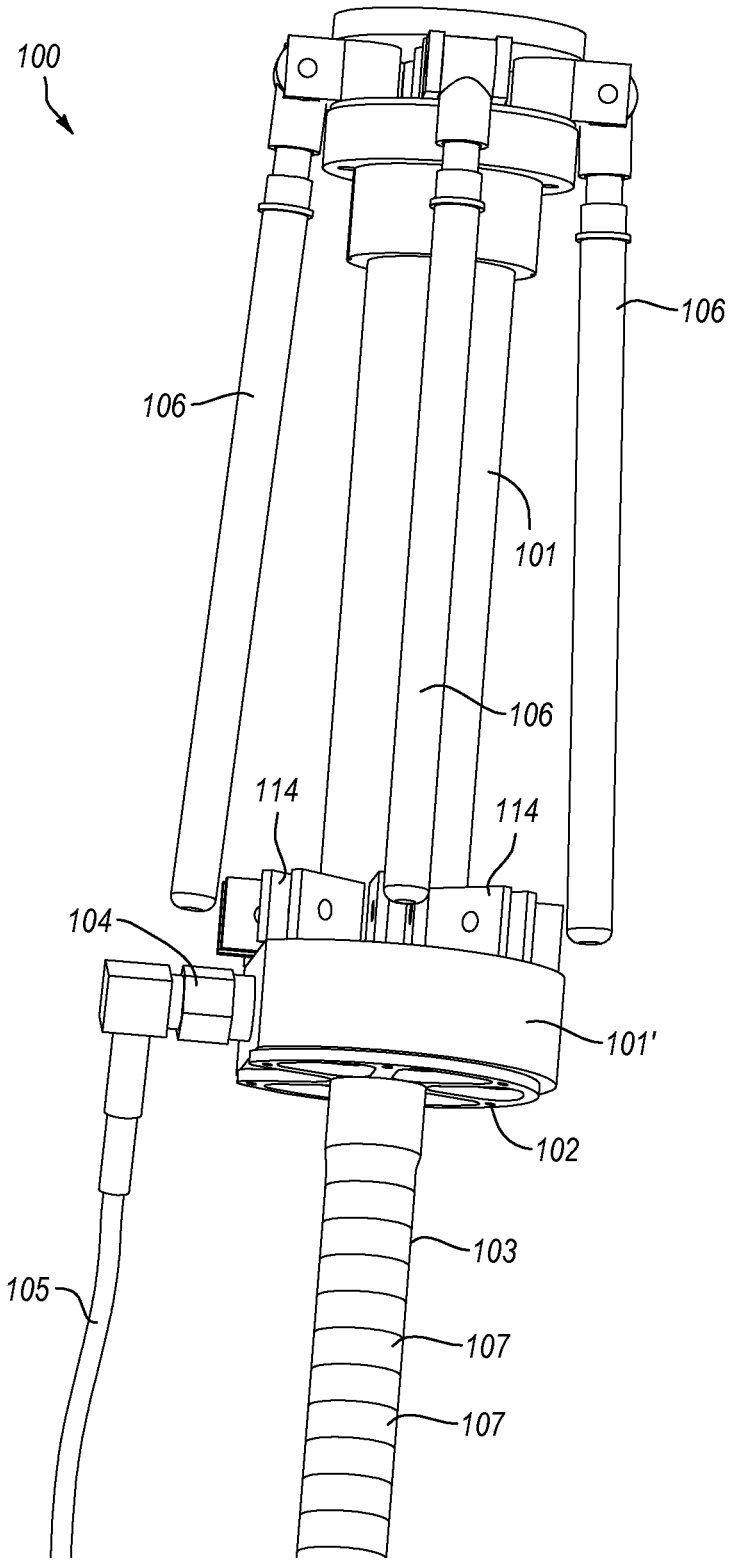
FIG. 1A is a perspective view of the top portion of an exemplary antenna system with the antenna members retracted.

The present invention is directed to a pedestrian transportable antenna system configured to be easily and quickly mountable to a back of a user (e.g., through mounting the system to a vest or flak jacket). The antenna system includes an antenna mount, a bendable rigid rod attached to the antenna mount, and an antenna attached to the opposite face of the antenna mount. The antenna includes a connection for an antenna cable, and one or more selectively extendable and retractable antenna members. The bendable rigid rod is sufficiently rigid to support the weight of the antenna at a specified orientation (e.g., oriented generally vertically). At the same time, the bendable rigid rod is bendable to a different specified orientation when sufficient force is applied (e.g., laterally) to adjust the bendable rigid rod. For example, the bendable rigid rod may be bent downward, over the user's shoulder to allow the user to easily step into a vehicle.

II. Exemplary Antenna Systems

The antenna may be used, for example, for satellite based communication. The bendable rigid rod is sufficiently rigid to provide support for a mounted antenna such that a user can walk around with the antenna deployed while the rod is received into mounting structure on a vest or flak jacket. The rod is also sufficiently bendable so as to permit the bendable rigid rod to be drawn closer into a user's body when the antenna is not deployed.

In one embodiment, a bottom face of the antenna mount (e.g., configured as a mounting plate) is attached to the bendable rigid rod. An antenna may be mounted on the top face of the antenna mount. A free end of the bendable rigid rod is mounted to a user (e.g., using MOLLE loops or other fastening devices) so that the system may be securely supported without a continuing need for grasping by the user's hands (i.e., hands free). The rod is bendable but self-supporting, so that when moved into a specified orientation (e.g., generally vertical), the bendable rigid rod has sufficient rigidity to maintain the specified position under the weight of the mounted antenna. However, with sufficient force applied by a user, the specified orientation of the bendable rigid rod can be adjusted either temporarily, only when the force is applied, or persistently, even after the force is no longer applied.

In some embodiments, the free end of the bendable rigid rod is mounted to the back of a user (e.g., into a back portion of a vest or flak jacket). So mounted, the bendable rigid rod can be adjusted into a generally vertical position for antenna deployment (i.e., extension of antenna members). When the antenna is undeployed (i.e., antenna members retracted), the bendable rigid rod can be bent over the user's shoulder and the top antenna portion of the system attached to the user's front chest side of the vest or flak jacket.

Advantageously, the antenna system allows for hands-free use, so that the user's hands are free for other tasks, not being required to support the bendable rigid rod or other antenna system components in a desired generally vertical configuration for use. Similarly, it is not required that the user continue to hold the bendable rigid rod in a bent configuration when the antenna system is in the undeployed bent-over configuration, but the top portion of the antenna system may be secured to a front chest portion of the user's vest or flak jacket.

Figure 1B:
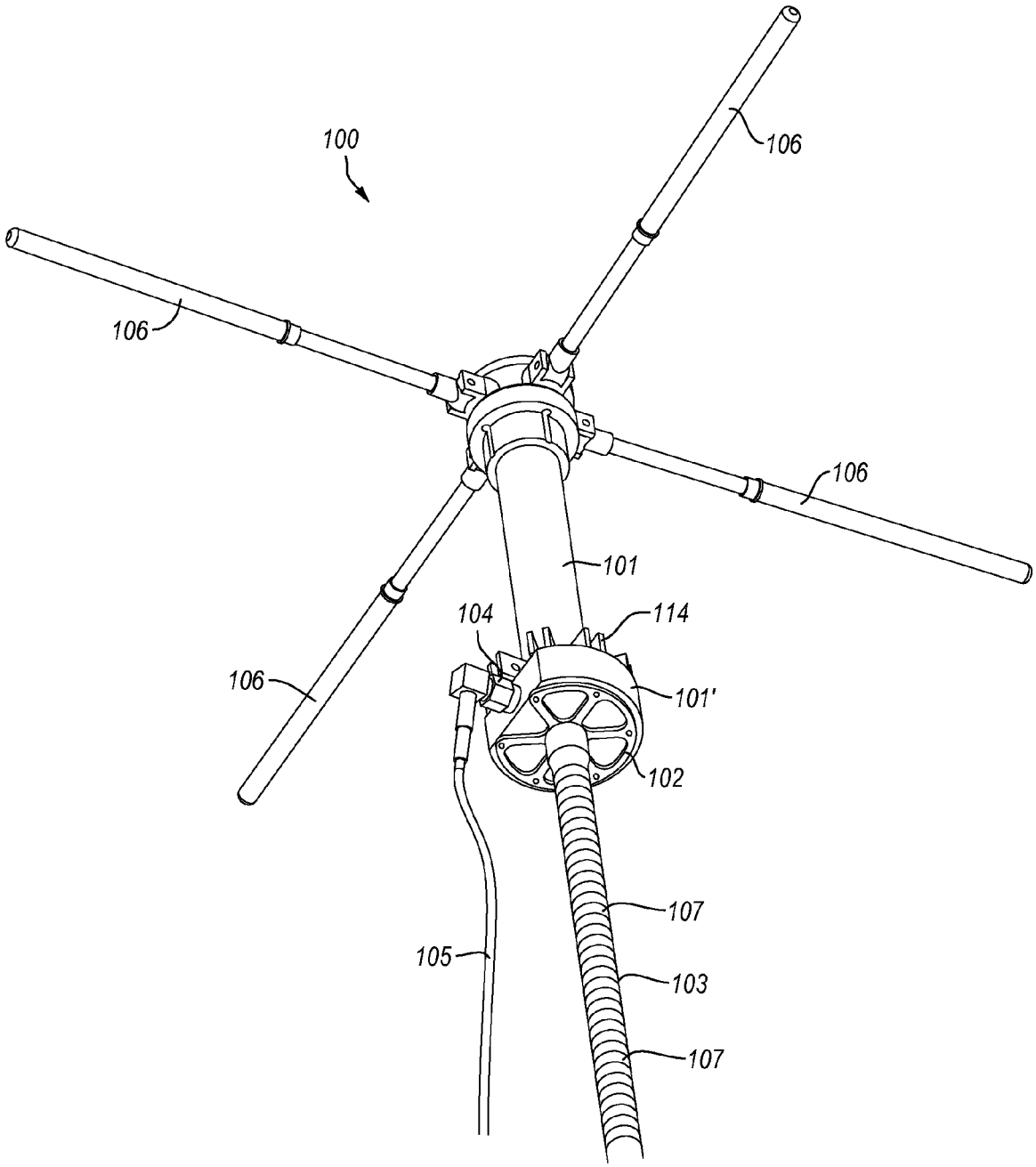
FIG. 1B is a perspective view of the antenna system of FIG. 1A with the antenna members extended, showing a bottom surface of the mounting plate to which the bendable rigid rod is attached.
Figure 1C:
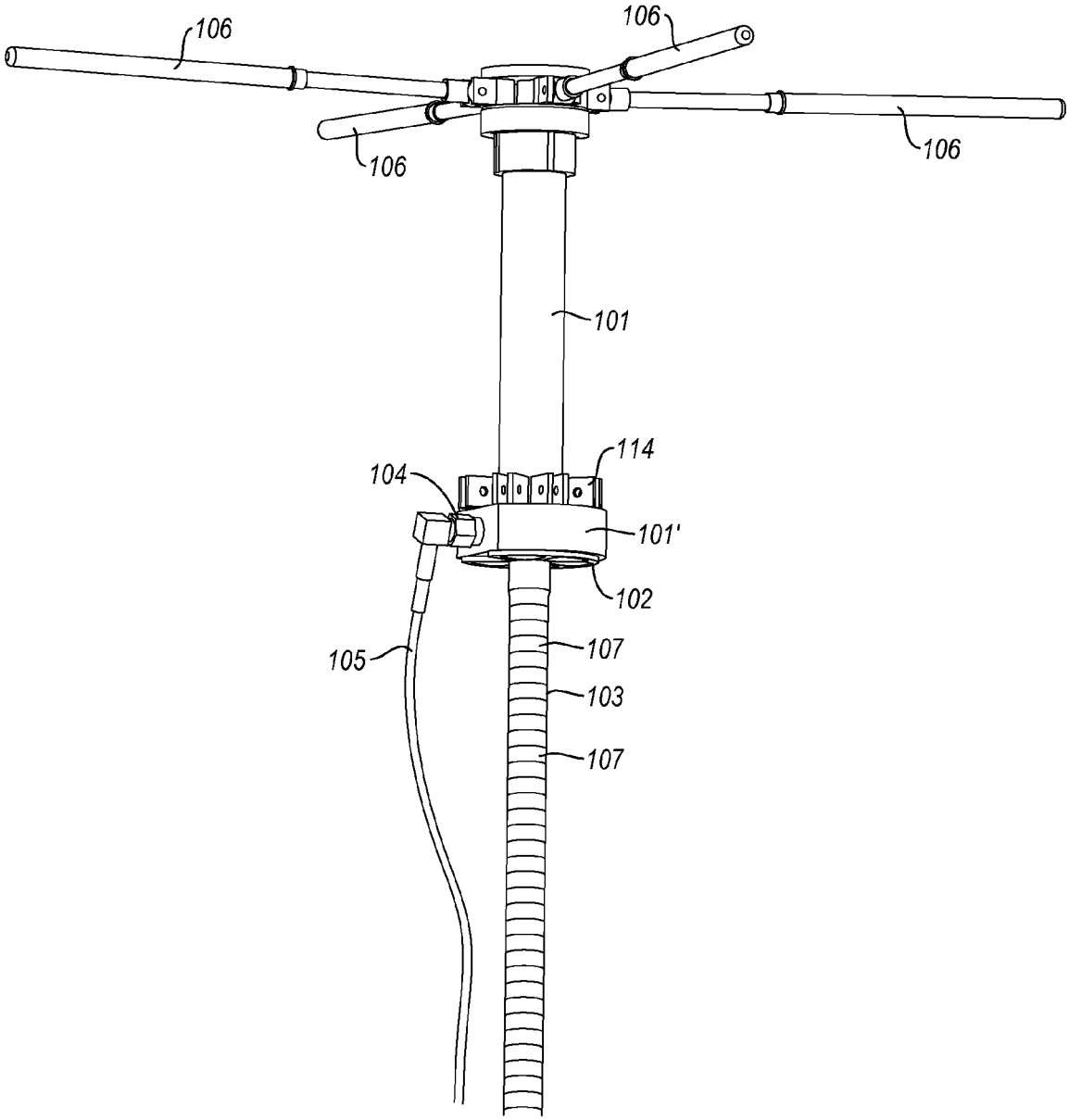
FIG. 1C is another perspective view of the antenna system of FIG. 1A with the antenna members extended.

FIGS. 1A-1C illustrate different views of an exemplary antenna system 100. As shown in FIG. 1A, antenna system 100 includes antenna column 101, mounting plate 102, bendable rigid rod 103, cable connector 104, antenna cable 105, and one or more antenna members 106. Antenna column 101 can be attached to mounting plate 102 using a threaded screw connection, additional screws, adhesives, a friction fit and/or any other appropriate mounting mechanism. Column 101 may include an enlarged flange at its bottom end. In the illustrated configuration, enlarged flange 101' may have a diameter or surface area similar to that of mounting plate 102 to which it is attached. Cable connector 104 provides an electrical communicative connection between the antenna components and cable 105. The other end of antenna cable 105 can connect to a communication device, such as, for example, a satellite radio.

FIG. 1B shows a view of the bottom of mounting plate 102, attached to bendable rigid rod 103. For example, mounting plate 102 may include a centrally disposed cylindrical member that friction fits into a hollow top end of bendable rigid rod 103. FIG. 1B shows antenna members 106 deployed in an extended configuration, while FIG. 1A shows antenna members 106 in a collapsed configuration in which they are arranged in a compact configuration around antenna column 101. As depicted in FIG. 1B, antenna members 106 are deployed so as to extend substantially perpendicularly and laterally relative to column 101. In addition, as seen in FIGS. 1A and 1B, each antenna member 106 may include two or more telescoping members, or another mechanism by which the antenna member 106 extends to a longer length when deployed as compared to when broken down for compact storage.

Bendable rigid rod 103 is self-supporting so as to be capable of maintaining itself in a generally vertical orientation, without bending merely under the weight of antenna components 102, 101, 101', and 106, and in the absence of other bending forces being applied to the rod 103. At the same time, rod 103 is bendable so that when a lateral force is applied, the rod can be bent, either persistently or temporarily, so as to allow a user with the antenna system mounted into mounting structure in a worn vest 111 or flak jacket (FIG. 2A) to bend the rod 103 over the user's shoulder (FIG. 2E). The antenna members 106 can be collapsed and secured to the front of the worn vest 111 or flak jacket, when the rod 103 is bent, by using securing structures, such as fastener 112, on the front chest portion of vest 111 (FIG. 2E).

As seen, bendable rigid rod 103 may comprise a helically coiled self-interlocked structure, for example, similar to Flexible Metallic Tubing ("FMT") or Flexible Metallic Conduit ("FMC"), sometimes referred to as "Greenfield" or "Flex". Such a bendable flexible rod 103 may be formed by helically coiling a self-interlocked ribbed strip of aluminum, steel, or other metal, forming a hollow bendable rigid rod. Such a helically coiled ribbed structure could also be formed of a strip of plastic. The coiled rod may be covered with a plastic skin, which may provide increased stiffness so as to aid the bendable rigid rod in maintaining a desired bent or vertical configuration. As shown, the helical coiled configuration may result in a plurality of helically wound ribs 107. Such a ribbed configuration allows the rod to bend as adjacent rib or coil segments adjust relative to one another as the rod is bent under applied force.

The diameter, length and cross-sectional shape of the rod 103 can vary to accommodate different needs and preferences. In some embodiments, the cross-sectional shape of the rod 103 is circular. In other embodiments the cross-sectional shape of the rod is elliptical, rectangular, triangular or another shape.

The length of the rod 103 can vary from under 1 foot to over 6 feet in length. Preferably, however, the rod 103 is within a range of about 2-4 feet. The diameter of the rod 103 can vary from under 0.25 inches to over 2 inches. However, the diameter of the rod 103 is preferably within a range of about 0.5 inches and 1.5 inches.

The rod 103 can also be substantially hollowed, to allow the cable 105 to pass there through. Alternatively, the rod 103 can be substantially solid, filled with any combination of one or more materials.

Various other features may be provided. For example, any of various clips 114 may be provided on column 101 or flange 101'. Such clips 114 may be helpful in holding cable 105 or other structure in a desired position or orientation.

Figure 2A:
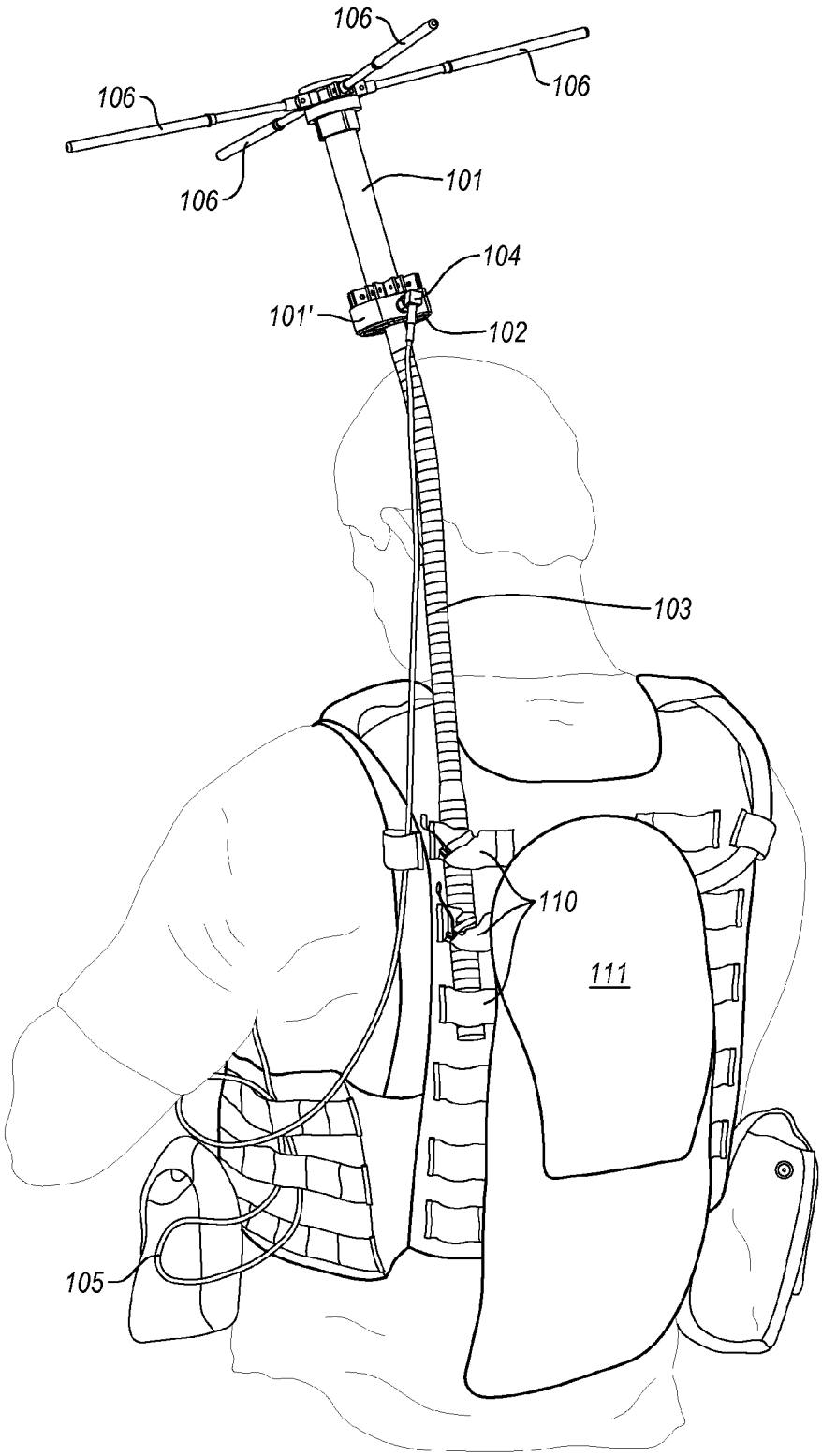
FIG. 2A is a perspective view of the antenna system of FIG. 1A with a bottom end of the bendable rigid rod of the system mounted to the back portion of a user's vest or flak jacket, the antenna members in an extended position.
Figure 2B:
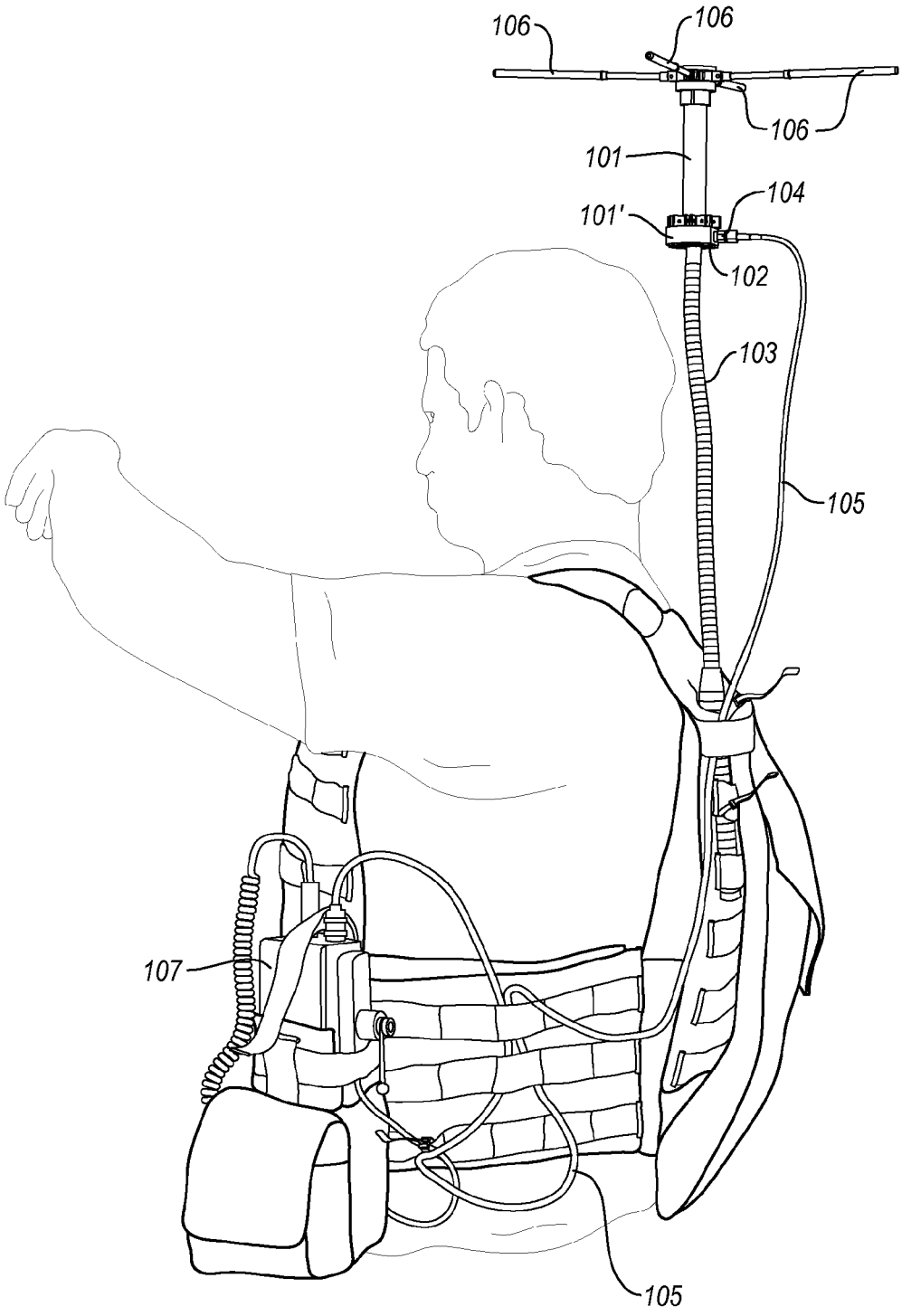
FIG. 2B is a side perspective view of the antenna system mounted to the back portion of the user's vest as shown in FIG. 2A.
Figure 2C:
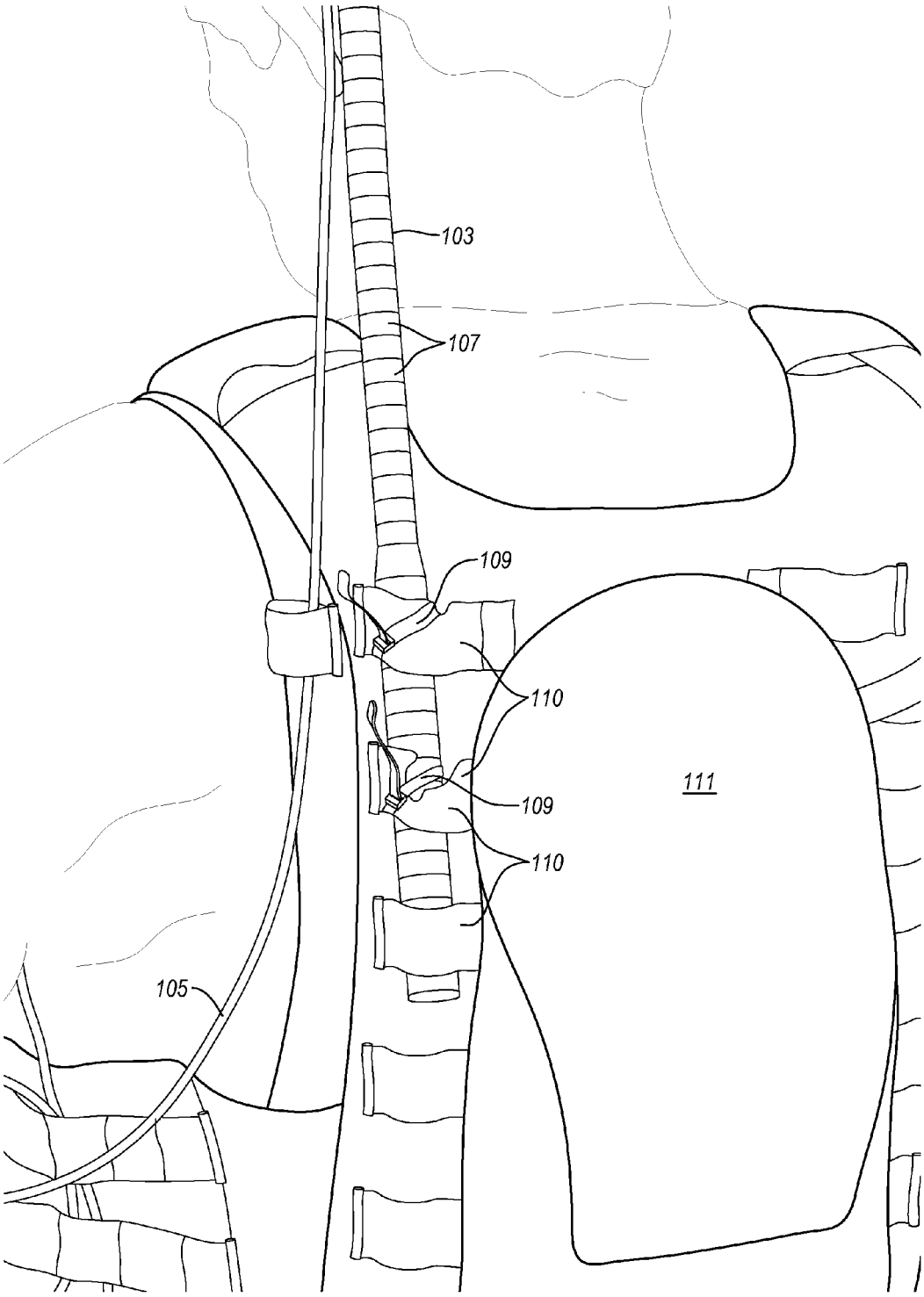
FIG. 2C is a close up perspective view of the antenna system mounted to the back portion of the user's vest as shown in FIG. 2A.
Figure 2D:
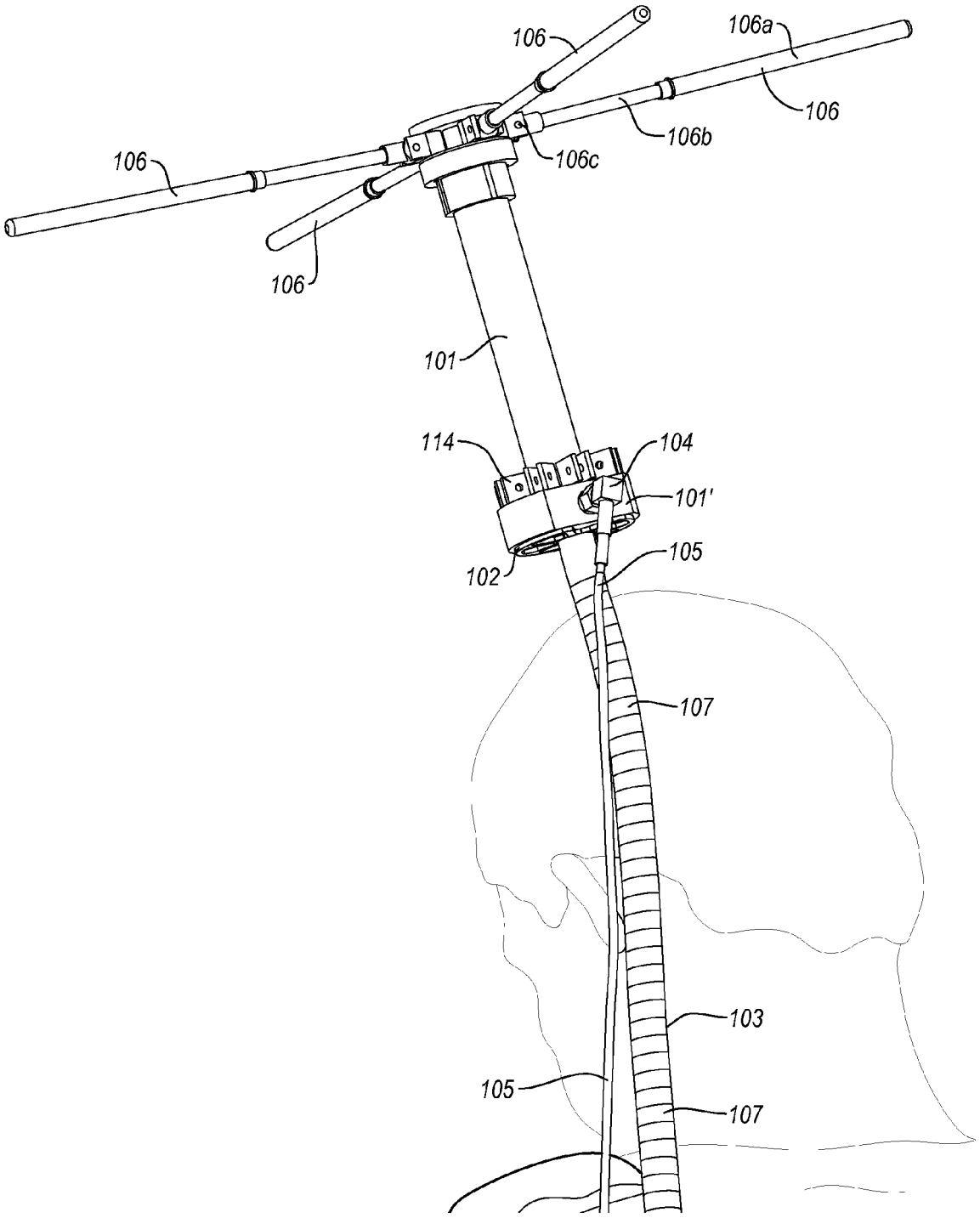
FIG. 2D is a close up perspective view of the top portion of the antenna system including the extended antenna members of FIG. 2A-2B, with the system mounted to the back portion of the user's vest as shown in FIG. 2A.
Figure 2E:
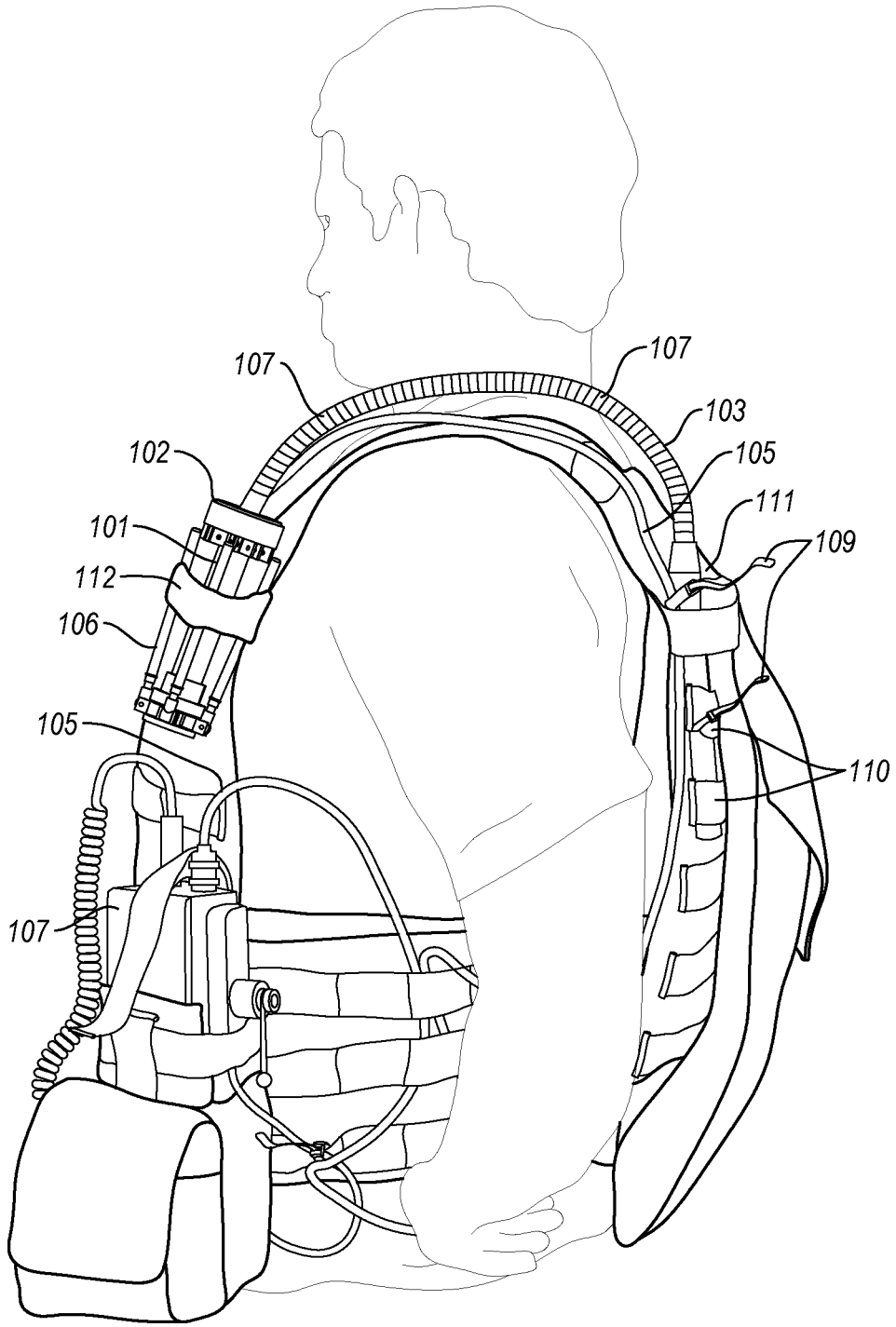
FIG. 2E is a side perspective view similar to that of FIG. 2B, but in which the bendable rigid rod has been bent over the user's left shoulder and in which the top portion of the antenna system has been secured to the front chest portion of the user's vest.

FIGS. 2A-2E illustrate various views of antenna system 100 mounted to the back of a user (e.g., mounted within MOLLE loops on the back portion of a vest 111 or flak jacket). As depicted in FIG. 2A, bendable rigid rod 103 can be mounted to vest 111 on the user's back by inserting an end of rod 103 into MOLLE loops 110, snap fasteners, zipper fasteners, hook and loop fasteners, ties and/or other fastening devices disposed on the back surface of vest 111. Rod 103 is shown as oriented in an essentially vertical orientation, with antenna members 106 deployed in an extended configuration. As seen, rod 103 is self-supporting, able to support antenna components 102, 101, 101' and 106 disposed on a top portion of rod 103 in an essentially vertical orientation.

FIG. 2B shows a similar view of antenna system 100 mounted to the user's back and further depicts communication device 107 (e.g., a satellite radio capable of receiving and transmitting signals through the antenna) received within a pouch along a side or front portion of vest 111. As depicted in FIG. 2B, antenna cable 105 is connected to communication device 107, while an opposite end of cable 105 is coupled into an antenna connector 104 near mounting plate 102 on flange 101'. Antenna cable 105 can be attached externally (as depicted) or can be run down the center of flexible rod 103, such as when the rod 103 is hollowed and when the cable is connected along a central axis extending parallel to the axis of the columnar axis of the antenna column 101 (not shown).

FIG. 2C depicts a close-up view of the back of the user, including the back portion of vest 111 with bendable rigid rod 103 received within MOLLE loops 110 of vest 111. As depicted in FIG. 2C, auxiliary attachments 109 (e.g., tie wraps, also known as zip ties) may be used to provide additional securance of bendable rigid rod 103 to vest 111 and/or loops 110. Ties 109 are shown as wrapped around rod 103 with loops 110 sandwiched between rod 103 and tie 109, securing rod 103 into loops 110.

FIG. 2D depicts a close-up view of the upper portion of antenna system 100, showing elongate column 101 extending perpendicularly relative to mounting plate 102, along generally the same longitudinal axis of rod 103. As seen, antenna members 106 may be hingedly attached at a proximal end thereof to a top portion of column 101. Antenna members 106 may include a telescoping configuration in which a distal portion 106*a* can be extended relative to the hingedly attached proximal portion 106*b*. FIG. 1A shows how antenna members 106 may be collapsed about column 101 where each antenna member 106 is also collapsed to a length approximately equal to that of the height of column 101 (e.g., by rotating the hinged proximal portion about hinge 106*c* and collapsing the distal portion 106*a* telescopically, coaxially with the proximal portion 106*b*). As shown, the distal and proximal portions of each antenna member 106 may be approximately equal in length, and each approximately equal to the height of column 101, providing a collapsed configuration such as that shown in FIG. 1A.

It will be readily apparent that other antenna member configurations may be employed in conjunction with a bendable rigid rod 103, which rod allows a user to easily and quickly bend the top portion of the antenna system 100 over the user's shoulder to allow the user to step through a door, into a vehicle, etc. Collapsibility of antenna components 106 about column 101 is beneficial in combination with the bendability of rod 103 for this purpose.

As depicted, in FIG. 2E, the user can bend bendable rigid rod 103 over the user's shoulder for attachment to the front side of vest 111 (e.g., after antenna members 106 are retracted). The top portion of antenna system 100 (e.g., antenna members 106, column 101) may be secured by any suitable mechanism (e.g., using MOLLE loops, hook and loop connection system, zipper fasteners, snap fasteners, etc.). For example, in one embodiment, one or more strap members 112 with corresponding hook and loop structures may be provided so that the strap(s) 112 may be extended over bent over top antenna components 106, 101, while the end of the strap is secured to another strap or a portion of vest 111 with hook and loop or other suitable connections.

Accordingly, embodiments of the invention use an antenna mount that is a flexible, bendable, mold-able mounting solution for satellite antennas that are mounted on pedestrians, robots or other objects. The flexible rod or arm (e.g., bendable rigid rod 103) can be made of either metal or plastic. The mounting solution allows a user to "bend" a typically bulky satellite antenna out of the way in order to allow moving in and out of doors and in and out of vehicles with the antenna system mounted on the person. The flexible rod is stiff enough to stand erect when a person walks, but flexible enough to bend nearly in half (i.e., a very tight radius of curvature—e.g., less than 6 inches, less than 3 inches, less than 2 inches, or less than 1 inch), to facilitate bending the antenna out of the way of the person using it and/or into a desired placement for use. The flexibility of the rod also facilitates protecting the antenna as well. For example, in case of getting bumped the antenna can flex out of the way, thereby reducing potential damage. This is particularly beneficial when considering that the antenna system is likely to be used in a combat zone, where movements of the user must often be made quickly.

In one embodiment, the flexible rod can use a custom adapting bracket (e.g., plate 102) having different shapes and configurations that allows affixing satellite antenna of different shapes and configurations) to the flexible rod. This mounting bracket can, therefore, be customized to whatever satellite antenna is used, including antenna with large or small, round or angled and threaded or smooth mounting columns. The flexible rod can be routed through the MOLLE loops in a soldier's equipment, and secured at its bottom end using a small pouch (e.g., a loop open at the top and closed at the bottom, for example by stitching the bottom of the loop into the vest). In one embodiment, the flexible rod may use hook and loop tape to secure it to the small pouch that is in turn mounted to the MOLLE loops.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A pedestrian transportable antenna system comprising:

an antenna mount;

an antenna mounted on the antenna mount, the antenna including a connection for an antenna cable, the antenna including one or more selectively extendable and retractable antenna members; and a bendable rigid rod attached to the antenna mount, the bendable rigid rod being sufficiently rigid to support a weight of the antenna atop the bendable rigid rod when the bendable rigid rod is adjusted to have a generally vertical orientation, the bendable rigid rod being bendable to a different specified orientation when sufficient force is applied to adjust the bendable rigid rod.

2. The pedestrian transportable antenna system as recited in claim 1, further comprising an antenna cable connected to the connection of the antenna, the antenna cable also being connected to a communication device.

3. The pedestrian transportable antenna system as recited in claim 2, wherein the communication device to which the antenna cable is connected comprises a radio.

4. The pedestrian transportable antenna system as recited in claim 1, wherein the bendable rigid rod is mounted to a user's back thereby permitting the user to:

adjust the orientation of the bendable rigid rod, including adjusting the orientation of the bendable rigid rod to a generally vertical orientation to deploy the antenna by extending the antenna members; and to adjust the orientation of the bendable rigid rod over the user's shoulder for attachment of the antenna to the user's chest when the antenna is undeployed by retracting the antenna members.

5. The pedestrian transportable antenna system as recited in claim 4, wherein the bendable rigid rod is mounted to a back portion of a vest worn by the user.

6. The pedestrian transportable antenna system as recited in claim 5, wherein the antenna is secured to a front portion of the vest worn by the user when the antenna is undeployed by retracting the antenna members.

7. The pedestrian transportable antenna system as recited in claim 1, wherein the bendable rigid rod comprises a ribbed, helically coiled interlocked metallic or plastic member that allows the rod to bend as adjacent individual coil segments are adjusted relative to one another.

8. The pedestrian transportable antenna system as recited in claim 7, wherein the bendable rigid rod comprising a ribbed, helically coiled interlocked metallic or plastic member further comprises a plastic skin.

9. A pedestrian transportable antenna system comprising:

an antenna mounting plate;

an antenna mounted on the mounting plate, the antenna including a connection for an antenna cable, an elongate column, and one or more selectively extendable and retractable antenna members attached to a top portion of the elongate column; and a bendable rigid rod attached to an end of the mounting plate opposite that of the antenna, the bendable rigid rod being sufficiently rigid to support a weight of the antenna atop the bendable rigid rod when the bendable rigid rod is adjusted to have a generally vertical orientation, the bendable rigid rod being bendable to a different specified orientation when sufficient force is applied by a user to adjust the bendable rigid rod.

10. The pedestrian transportable antenna system as recited in claim 9, further comprising an antenna cable connected to the connection of the antenna, the antenna cable also being connected to a communication device.

11. The pedestrian transportable antenna system as recited in claim 10, wherein the communication device to which the antenna cable is connected comprises a radio.

12. The pedestrian transportable antenna system as recited in claim 9, wherein the bendable rigid rod is mounted to a user's back thereby permitting the user to:

adjust the orientation of the bendable rigid rod, including adjusting the orientation of the bendable rigid rod to a generally vertical orientation to deploy the antenna by extending the antenna members; and to adjust the orientation of the bendable rigid rod over the user's shoulder for attachment of the antenna to the user's chest when the antenna is undeployed by retracting the antenna members.

13. The pedestrian transportable antenna system as recited in claim 12, wherein the bendable rigid rod is mounted to a back portion of a vest worn by the user.

14. The pedestrian transportable antenna system as recited in claim 13, wherein the antenna is secured to a front portion of the vest worn by the user when the antenna is undeployed by retracting the antenna members.

15. The pedestrian transportable antenna system as recited in claim 9, wherein the bendable rigid rod comprises a ribbed, helically coiled interlocked metallic or plastic member that allows the rod to bend as adjacent individual coil segments are adjusted relative to one another.

16. The pedestrian transportable antenna system as recited in claim 15, wherein the bendable rigid rod comprising a ribbed, helically coiled interlocked metallic or plastic member further comprises a plastic skin.

17. The pedestrian transportable antenna system as recited in claim 9, wherein each antenna member comprises a proximal portion and a distal portion telescopingly disposed relative to one another, the proximal portion being hingedly connected to the elongate column.

18. A pedestrian transportable antenna system comprising:

an antenna mounting plate;

an antenna mounted on the mounting plate, the antenna including a connection for an antenna cable, an elongate column, and one or more selectively extendable and retractable antenna members hingedly attached to a top portion of the elongate column; and a bendable rigid rod attached to an end of the mounting plate opposite that of the antenna, the bendable rigid rod comprising a ribbed, helically coiled interlocked metallic or plastic member that allows the rod to bend as adjacent individual coil segments are adjusted relative to one another, the bendable rigid rod being sufficiently rigid to support a weight of the antenna atop the bendable rigid rod when the bendable rigid rod is adjusted to have a generally vertical orientation, the bendable rigid rod being bendable to a different specified orientation when sufficient force is applied by a user to adjust the bendable rigid rod.

19. The pedestrian transportable antenna system as recited in claim 18, wherein the bendable rigid rod comprising a ribbed, helically coiled interlocked metallic or plastic member further comprises a plastic skin.

20. The pedestrian transportable antenna system as recited in claim 18, wherein each antenna member comprises a proximal portion and a distal portion telescopingly disposed relative to one another, the proximal portion being hingedly connected to the elongate column.

* * * * *